US006769578B1

(12) United States Patent
Ciofalo et al.

(10) Patent No.: US 6,769,578 B1
(45) Date of Patent: Aug. 3, 2004

(54) CAULKING TUBE NOZZLE APPLICATOR

(76) Inventors: John Ciofalo, 432 Maitland Ave., Teaneck, NJ (US) 07666; Frank P. Ciofalo, P.O. Box 8, Pomona, NY (US) 10979

( * ) Notice: Subject to any disclaimer, the term of this patent is extended or adjusted under 35 U.S.C. 154(b) by 0 days.

(21) Appl. No.: 10/414,527

(22) Filed: Apr. 17, 2003

(51) Int. Cl.[7] ..... B67D 5/00
(52) U.S. Cl. ..... 222/566; 222/326
(58) Field of Search ..... 222/325–327, 222/391, 566, 567

(56) References Cited

U.S. PATENT DOCUMENTS 3,651,994 A * 3/1972 Nordenholt ..... 222/160
4,946,081 A * 8/1990 Jacobson ..... 222/568
4,995,540 A * 2/1991 Colin et al. ..... 222/132
5,029,738 A * 7/1991 Dillon ..... 222/527
5,749,498 A * 5/1998 Lavoie et al. ..... 222/192
5,976,102 A * 11/1999 Epstein ..... 604/35
6,478,561 B2 * 11/2002 Braun et al. ..... 425/12

* cited by examiner

*Primary Examiner*—J. Casimer Jacyna
(74) *Attorney, Agent, or Firm*—Charles I. Brodsky

(57) ABSTRACT

An applicator attachable to the nozzle of a caulking tube container including first and second sectional components of inflexible hard plastic aligned at an angle other than 0°, fitted over and around the nozzle a length to be held in place therewith by frictional force in facilitating dispensing of the contents of the container at hard-to-reach locations.

9 Claims, 1 Drawing Sheet

CAULKING TUBE NOZZLE APPLICATOR

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to caulking guns, in general, and to an applicator attachable to the nozzle of its tube container, in particular.

2. Description of the Related Art

Hand tools for displacing preselected compounds from a cylindrical tube are well known:

a. U.S. Pat. No. 4,198,756, for example, illustrates an extruder used in dentistry to dispensing flowable materials as employing a nozzle tip secured to a barrel having a front opening; and b. U.S. Pat. No. 4,295,828 shows a similar type of medical use device having a separable nozzle tip on a cartridge barrel.

Various applicators for attachment to these hand tools have also be described:

a. U.S. Pat. No. 5,017,113 illustrates a fillet forming caulking tool, in which a fillet forming member is triangular in configuration having two edges at approximately 45° to its center line;

b. U.S. Pat. No. 5,029,738 shows a caulking gun having a flexible spout connection to allow angular displacement in obtaining enhanced access. FIG. 5 therein shows a compressible body 12 to perform the angulation while FIG. 4 shows a solid dispenser tip 17 mounted with a deformable conical tip 18;

c. U.S. Pat. No. 5,249,716 includes a curved angle guide tube at 90—with FIG. 2 more specifically showing a nozzle assembly attached to the end of the caulking cannister, with the angle guide tube 90 fitted over the dispensing tube 40;

d. U.S. Des. Pat. No. 377,891 illustrates a caulking gun nozzle which, in FIG. 1, shows an apparent 45° bend;

e. U.S. Pat. No. 5,695,788 is concerned with a wall repairing tool having a passageway 22 coupled to the nozzle 4 in receiving the repair material utilized; and f. U.S. Pat. No. 6,076,712 illustrates a flexible caulk tube nozzle, best shown in FIG. 2 as having an accordion flexible section forming a tapered nozzle end portion.

While these hand tools, applicators and nozzles may work for their intended purposes, by and large they all are specialized arrangements, differing from what is generally available and typically used by a homeowner and contractor in the construction/repair field. There, the caulking container comprises a cylindrical dispensing tube having a co-linear nozzle at its end which conventionally is first cut at its end and then turned 90° for use. Whether the preselected compound stored in the tube be an adhesive, a filler, or any other type material, the nozzle nose end of the tube is generally rounded as sold, and the nozzle extends into the tube through a slot cut within a barrel in which the tube is arranged to freely rotate. Instances arise, however, where caulking guns and tubes of these natures are both inconvenient and difficult to employ in certain angle situations where a straight-line application is inconvenient in practice.

SUMMARY OF THE INVENTION

As will become clear from the following description, the present invention comprises an applicator of inflexible hard plastic which is attached to the existing nozzle of the caulking tube container. The nozzle includes a pair of substantially circular cross-section components, the first of which fits over and around the nozzle a length to be held in place therewith by frictional force; such first sectional component will be seen to be of uniform circular cross-section substantially along its length about the nozzle itself. The second sectional component, on the other hand, tapers from a larger diameter at the first sectional component toward a smaller diameter remote therefrom, and at an alignment angle of other than 0°. In specific constructions, angles of 45°, or 90°, are preferable.

Such applicator may be attached to the nozzle of an elongate generally cylindrical dispensing tube which stores a preselected compound for subsequent displacement. When used with a caulking gun having a plunger reciprocable to dispense the stored compound, the cylindrical caulking tube is selected of a diameter so as to allow it to be freely rotatable within the barrel. A first end of the tube then receives the plunger, and a second end of the tube terminates in a conically tapered plastic nozzle at its opposite end. Again with the applicator being composed of an inflexible hard plastic, aligned with the nozzle at an angle other than 0°, the caulking tube can be rotated within the barrel of the gun so as to orient the adaptor for the correct dispensing of the compound bead. In use, if the preselected compound in the cannister is water soluble, the adaptor of the invention could be run under a faucet after use, cleaned and reused at a later time. If an oil-based compound is employed, on the other hand, being composed of a hard inflexible plastics the, applicator can be discarded without trepidation, because of its inexpensive manufacturing cost. The plastic for the adaptor in this respect may typically be of the same composition as of the nozzle on the container itself.

BRIEF DESCRIPTION OF THE DRAWINGS

These and other features of the present invention will be more clearly understood from a consideration of the following description of the invention, shown in conjunction with the accompanying drawings, in which.

DETAILED DESCRIPTION OF THE INVENTION

Figure 1:
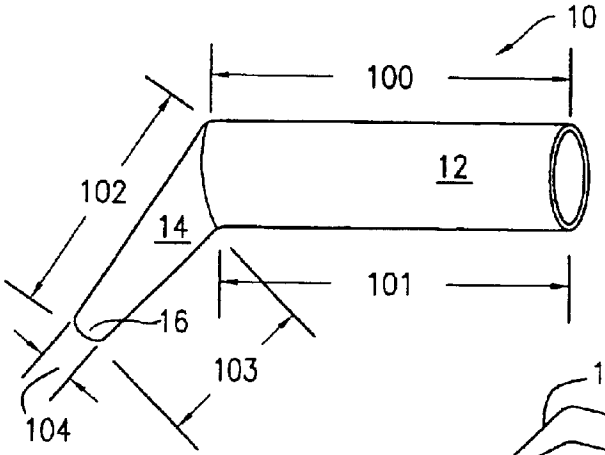
FIG. 1 is a perspective view of an applicator embodying the invention for attachment to the nozzle of a caulking tube container.
Figure 2:
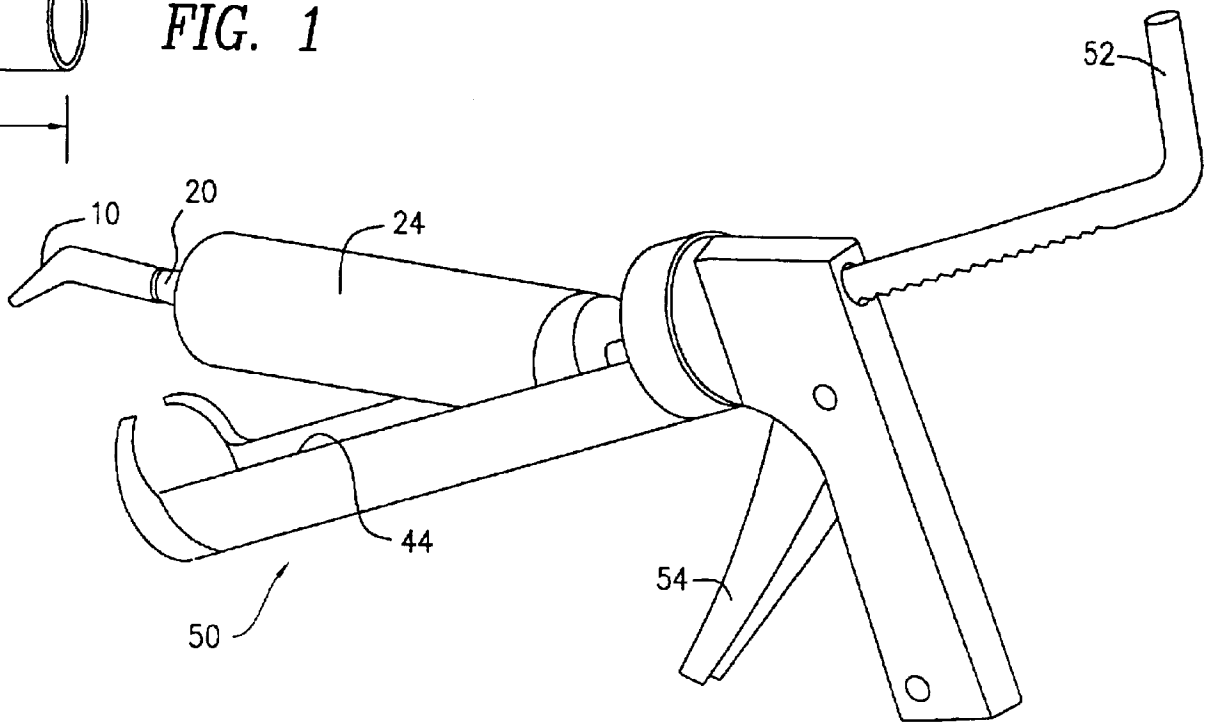
FIG. 2 is helpful in an understanding of the manner by which the applicator can be effectively utilized.

The applicator of the invention as shown in FIGS. 1 and 2 is shown at 10, being composed of first and second sectional components 12, 14, each of substantially circular cross-section. The first sectional component 12 is adapted for fitting over and around the nozzle 20 of a caulking tube container 24 a length to be held in place therewith by frictional force. Preferably, the first sectional component 12 is of uniform circular cross-section substantially along its entire length—of, for example, an inside diameter of ½ inch, of outside diameter ⅝ inch and of a thickness 1/16 inch. In one construction of the preferred embodiment, the length 100 was selected at 2⅜ inch, and the length 101 was selected as 2 3/16 inch, although other dimensions, of course, may be utilized instead.

The second sectional component 14, on the other hand, tapers from a larger diameter at the first sectional component 12 toward a smaller diameter remote therefrom to a generally rounded end 16. With both the sectional components 12, 14 being composed of an inflexible hard plastic, the two components are aligned with one another at an angle other than 0°, as illustrated. Preferably, for conventional construction and repair use, the two components 12, 14, may be aligned at angles of 45° or 90°. In the construction illustrated in FIG. 1, the length 102 was selected of 1⅜ inch while that of the length 103 was selected of a 1 3/16 inch. The rounded end 16 may be of a diameter 104 of 3/16 inch.

In attaching the applicator for use, the first sectional component 12 is slid onto the conically tapered plastic nozzle 20 of a generally cylindrical cannister 24 of a diameter freely rotatable within the barrel 44 if a caulking gun generally shown at 50. The elongated barrel 44 cooperates with a plunger 52 and a manually engagable means 54 to reciprocate the plunger 52 toward the near end of the barrel 44 in exerting the pressure upon the cannister 24 in well known manner to dispense the preselected caulking compound stored within. In accordance with the invention, the diameter of the cannister allows its free rotation within the barrel so as to position the angled applicator to most effectively dispensed beads of the compound at the location desired.

In use, the angled applicator 10 is slid onto the cannister nozzle 20 where it fits snugly by friction without any need for twisting or threading. When a task is completed, a jiggling of it is sufficient in backing the applicator off. Usage a plastic applicator upon a plastic nozzle will be appreciated as giving rise to sufficient friction to hold the two together. Obviously, with different diameter cannister nozzles, different diameter applicator dimensions would be required—but a fitting of the two together a length of 1½ to 1¾ inch amount has been determined to be all that is necessary to secure the two devices in being held by friction. Rotating the cannister within the barrel becomes all that is necessary for the desired orientation of the applicator, which needs no further hand support to be held in place when dispensing the cannister compound. Because the applicator is composed of an inflexible hard plastic, it can be manufactured inexpensively, and sold at a reasonable price—for example, $1.89 for a package of three. Such package might include adaptors, with a 45° bend, a 90° bend, and 22½ bend, or different numbers or combinations of them. The second sectional component 14 will be understood to be threaded so as ease the preselected caulking or like compound to feed through to the spot being worked upon in as easy a manner as possible.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

We claim:

1. An applicator attachable to the nozzle of a caulking tube container comprising:

first and second sectional components, each of substantially circular cross-section;

said first sectional component being adapted for fitting over and around said nozzle a length to be held in place therewith by frictional force, said first sectional component being of uniform circular cross-section substantially along its length about said nozzle;

said second sectional component tapering from a larger diameter at said first sectional component toward a smaller diameter remote therefrom;

with said first and second sectional components being aligned with one another at an angle other than 0°; and with said first and second sectional components each being composed of inflexible hard plastic.

2. The applicator of claim 1 wherein said first and second sectional components are aligned with one another at an angle of 45°.

3. The applicator of claim 1 wherein said first and second sectional components are aligned with one another at an angle of 90°.

4. The combination comprising:

a caulking gun having an elongated barrel, a plunger reciprocable therein, and manually engagable means at one end of said barrel operable to reciprocate said plunger toward said one end of said barrel;

an elongated caulking tube having a generally cylindrical canister of a diameter freely rotatable within said barrel, and having a first end for receiving said plunger and a second end terminating in a conically tapered plastic nozzle at an end thereof remote from said one end of said barrel; and an applicator attachable to said nozzle including first and second sectional components, each of substantially circular cross-section; with said first sectional component being adapted for fitting over and around said nozzle a length to be held in place therewith by frictional force, with said first sectional component being of uniform circular cross-section substantially along its length about said nozzle; with said second sectional component tapering from a larger diameter at said first sectional component toward a smaller diameter remote therefrom; with said first and second sectional components being aligned with one another at an angle other than 0°; and with said first and second sectional components each being composed of inflexible hard plastic.

5. The combination of claim 4 wherein said first and second sectional components of said applicator are aligned with one another at an angle of 45°.

6. The combination of claim 4 wherein said first and second sectional components of said applicator are aligned with one another at an angle of 90°.

7. An applicator attachable to the nozzle of an elongate generally cylindrical dispensing tube storing a preselected compound for subsequent displacement therefrom comprising:

first and second sectional components, each of substantially circular cross-section;

said first sectional component being adapted for fitting over and around said nozzle a length to be held in place therewith by frictional force, said first sectional component. being of uniform circular cross-section substantially along its length about said nozzle;

said second sectional component tapering from a larger diameter at said first sectional component toward a smaller diameter remote therefrom;

with said first and second sectional components being aligned with one another at an angle other than 0°; and with said first and second sectional components each being composed of inflexible hard plastic.

8. The applicator of claim 7 wherein said first and second sectional components are aligned with one another at an angle of 45°.

9. The applicator of claim 7 wherein said first and second sectional components are aligned with one another at an angle of 90°.

* * * * *